US007373948B2

(12) United States Patent
Campbell et al.

(10) Patent No.: US 7,373,948 B2
(45) Date of Patent: May 20, 2008

(54) VARIABLE OUTPUT PRESSURE BACKUP VALVE

(75) Inventors: Sanford F. Campbell, Redding, CA (US); Suresh C. Gopalan, Simi Valley, CA (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 645 days.

(21) Appl. No.: 10/761,618

(22) Filed: Jan. 21, 2004

(65) Prior Publication Data

US 2005/0155655 A1 Jul. 21, 2005

(51) Int. Cl.
*F17D 3/00* (2006.01)

(52) U.S. Cl. ..... 137/624.11; 137/270; 251/205; 15/1.7

(58) Field of Classification Search ..... 137/624.11, 137/624.14, 624.13, 883, 269, 270; 251/205; 15/1.7

See application file for complete search history.

(56) References Cited

U.S. PATENT DOCUMENTS 3,384,338 A * 5/1968 Dermody ..... 251/205
4,007,749 A 2/1977 Pansini et al.
4,522,221 A 6/1985 Chivens et al.
6,158,464 A 12/2000 Campbell et al.

FOREIGN PATENT DOCUMENTS

EP 1130194 9/2001

* cited by examiner

*Primary Examiner*—Kevin Lee
(74) *Attorney, Agent, or Firm*—Greenberg Traurig LLP

(57) ABSTRACT

A backup valve for use with a pool cleaner coupled to a source of water under pressure. The valve includes a housing having an inlet and at least a first outlet and a second outlet. The valve further includes a timing apparatus directing water from said inlet to the first outlet or the second outlet. In addition, an adjustable flow controller over the second outlet is provided to increase the flow speed of fluid exiting the outlet.

7 Claims, 9 Drawing Sheets

VARIABLE OUTPUT PRESSURE BACKUP VALVE

BACKGROUND OF THE INVENTION

1. Field of the Invention

The present invention is directed to the field of automatic swimming pool cleaners, and more particularly, to reverse flow valves for use with pressure cleaners.

2. Description of the Related Art

Automatic swimming pool cleaners for cleaning the floor and sidewalls of a swimming pool are well known. There are generally four types of pool cleaners in the pool cleaning market: pressure or return-side cleaners; suction cleaners; electric cleaners; and in-floor cleaners. Generally, "pressure" or return-side cleaners perform superior cleaning over the other three types of cleaners. Pressure-type cleaners use pressurized water from a pump into the cleaner to sweep and collect debris into a bag carried by the cleaner.

Pressure cleaners can be characterized into at least two categories—those requiring a booster pump and those which do not. Booster pumps are used in conjunction with the pool's skimmer pump to provide pressurized water to the cleaner at a rate sufficient to operate the cleaner effectively.

One particular type of known automatic pressure cleaner is shown and described in U.S. Pat. No. 5,933,899 ("the '899 Patent"), fully incorporated herein by reference. The apparatus described in the '899 Patent does not require a booster pump; rather, it is designed to operate using the lower fluid pressure of the pool's existing filtration pump. Another type of cleaner is shown in U.S. Pat. No. 6,003,184.

Both of these types of cleaner operates on pressurized water that is supplied to the cleaner through a supply hose. The water is used in part to drive the blades of a turbine which, in turn, rotates two or more of the wheels, and in part to induce a flow of pool water upwardly through the cleaner suction mast and into the collection bag. The drive wheels and a thrust jet propel the cleaner along the floor and sidewalls of the swimming pool. When the pool cleaner reaches an obstruction preventing further direct forward travel, the drive wheels impart a turning movement, causing the cleaner to turn and continue travel in a different direction. Alternatively, when the cleaner travels along the pool floor and reaches a smoothly curved region merging with a sidewall, the cleaner tends to travel through the curved region and crawl at least part way up the pool sidewall until the cleaner falls by gravity back to the floor of the pool. A ballast float mounted at the upper rear of the cleaner helps assure that the cleaner will land upright on the pool floor and resume travel in a forward direction.

In addition to the drive system, backup valves are coupled to the water supply line between the pumping system and the cleaner. Backup valves provide additional insurance that a cleaner will not get stuck in edges or corners of pools by forcing a reversal of direction of the cleaner at regular intervals.

Construction of backup valves is well known. In particular, one such valve includes a housing containing a fly wheel, rotating cover plate, and gearing. The housing has a water inlet, and at least two water outlets directed generally toward the opposite end of the hosing from the inlet. One outlet is coupled by the supply line to the cleaner, while the other allows water to enter the pool directly, in a direction generally parallel to the supply line and the first outlet. Water is also prevented from entering the cleaner, thereby freeing backward movement of the cleaner. Water in the supply line enters the housing and drives the impeller to rotate the rotating cover plate to cover the first outlet and redirect water in the housing to the second outlet for a period of time determined by the gearing. The rotation of the gearing and the rotating cover plate determine the amount of time that water is allowed to flow to the cleaner, and the amount of time water flows into the pool to "backup" the cleaner.

With low pressure cleaners, that is, cleaners operating without the benefit of an additional booster pump, a difficulty has been found in obtaining the desired timing in backup valves due to the lower pressure of the water entering the inlet of the valve. Specifically, there is not enough pressure from the main water pressure source—without a booster pump—to accurately and regularly drive the impeller in the valve to ensure a constant spin rate and in some cases, not enough to even turn the wheel.

An improved backup valve is disclosed in U.S. Pat. No. 6,185,464 ("the '464 Patent"). This valve is designed to be used in conjunction with a low pressure cleaner, requiring a lower volume per unit time of fluid to function effectively. Improvements to backup valves which can compensate for lower flow rates of pumping systems without booster pumps allow the backup valves to be used with a wider variety of pumps and cleaners.

Another issue in the performance of backup valves exists with the weight of the cleaner. The heavier the cleaner, the more force which must be provided by the valve to reverse the tension on the water supply line to reverse the direction of the cleaner.

SUMMARY OF THE INVENTION

The invention, roughly described, comprises a backup valve for use with a pool cleaner coupled to a source of water under pressure. In one embodiment, the valve includes a housing having an inlet and at least a first outlet and a second outlet. The valve further includes a timing apparatus directing water from said inlet to the first outlet or the second outlet. In addition, an adjustable flow controller over the second outlet is provided to increase the flow speed of fluid exiting the outlet.

In one aspect, the flow controller comprises a securable plate.

In a further aspect, the plate includes a first bore having a diameter smaller than a diameter of said second outlet, and a second bore having a diameter equal to the diameter of said second outlet.

In a further aspect, a flow control structure is provided on the plate and is a conical structure.

In a further embodiment, the invention is a fluid flow direction valve. The valve includes a housing having an inlet coupled to a fluid supply, a first outlet and a second outlet. The valve further includes a valve structure positioned in the housing and directing fluid to the first or second outlet responsive to fluid entering the inlet. In addition, the valve includes a selectable pressure controller, mounted adjacent to the second outlet, allowing a user to select at least a first or second fluid speed for a flow of fluid exiting the housing.

The invention provides improved performance for both high and low fluid pressure environments when using a cleaning apparatus in swimming pools and the like. The invention allows a user to change the pressure and effectiveness of the backup valves in a variety of cleaning applications.

These and other objects and advantages of the present invention will appear more clearly from the following description in which the preferred embodiment of the invention has been set forth in conjunction with the drawings.

BRIEF DESCRIPTION OF THE DRAWINGS

The invention will be described with respect to the particular embodiments thereof. Other objects, features, and advantages of the invention will become apparent with reference to the specification and drawings in which.

DETAILED DESCRIPTION

Figure 1:
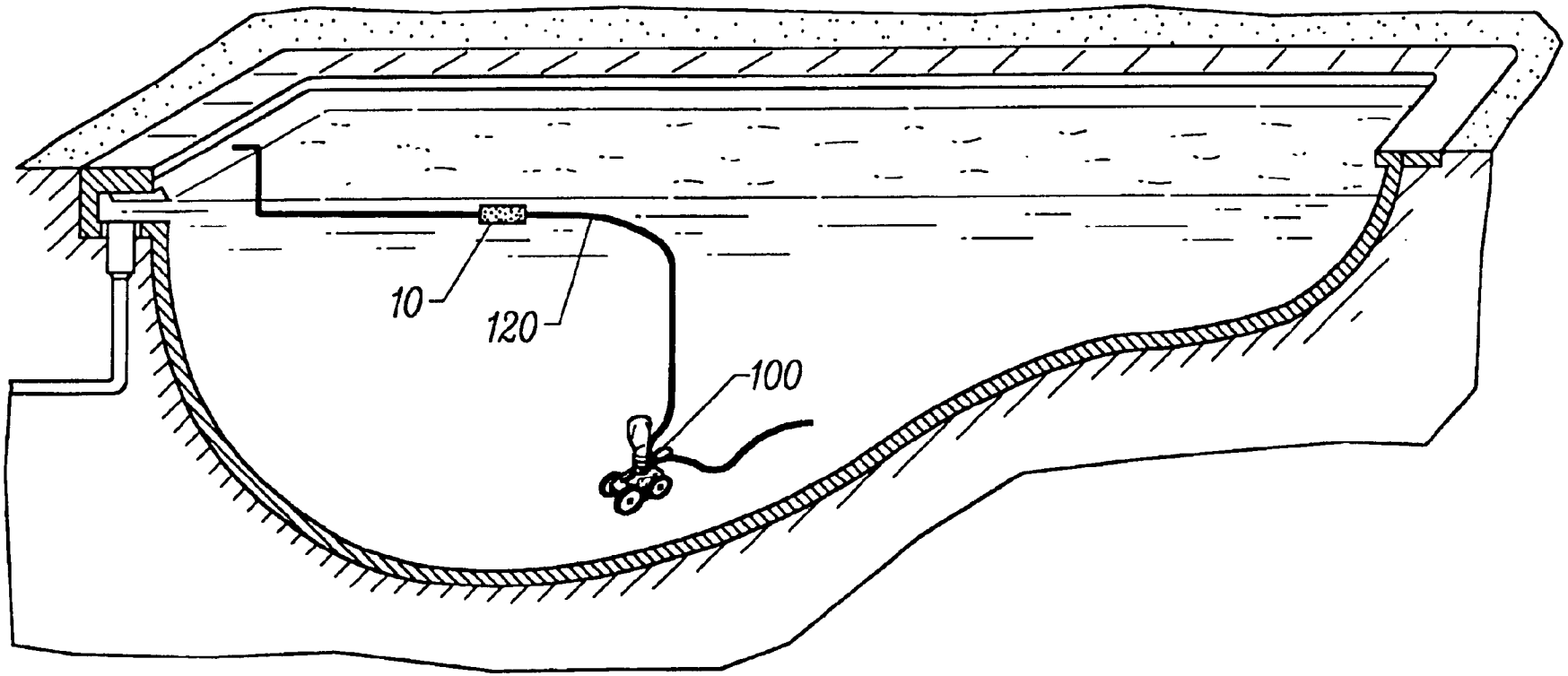
FIG. 1 is a perspective view of a pool cleaner in a pool.

FIG. 1 shows an automatic pool cleaner coupled to a supply line 120. The cleaner may be a pressurized cleaner, such as that specified in the '899 Patent, U.S. Design Pat. Ser. No. 29/171,340 entitled "Truck Cleaner" or may be any of a number of pool cleaners using water flow provided via the supply line 120 to operate the cleaner in the pool. It should be recognized that the particular characterization of the cleaner 100 used in conjunction with the backup valve of the present invention is not significant to the invention. Moreover, the valve use is not limited to pressure cleaners. The valve may be used with any type of cleaner where a reverse tension on a fluid supply line is desired to impart a force on the cleaner in a direction opposite to that in which the cleaner is traveling.

A backup valve 10 may be provided on supply line 120 as shown in FIG. 1. The backup valve redirects water entering the cleaner and literally pulls the cleaner in a backwards direction by forcing water out of the valve, reversing tension on the water supply line and pulling the cleaner backwards. This redirection occurs after a predetermined volume of water passes through the supply line 120, and under the control of a timing mechanism in the backup valve.

In accordance with the present invention, an improved backup valve 10 is disclosed. In particular, the backup valve of the present invention includes means to increase the pressure of the water entering the inlet as the water impacts the impeller in the housing.

Figure 2:
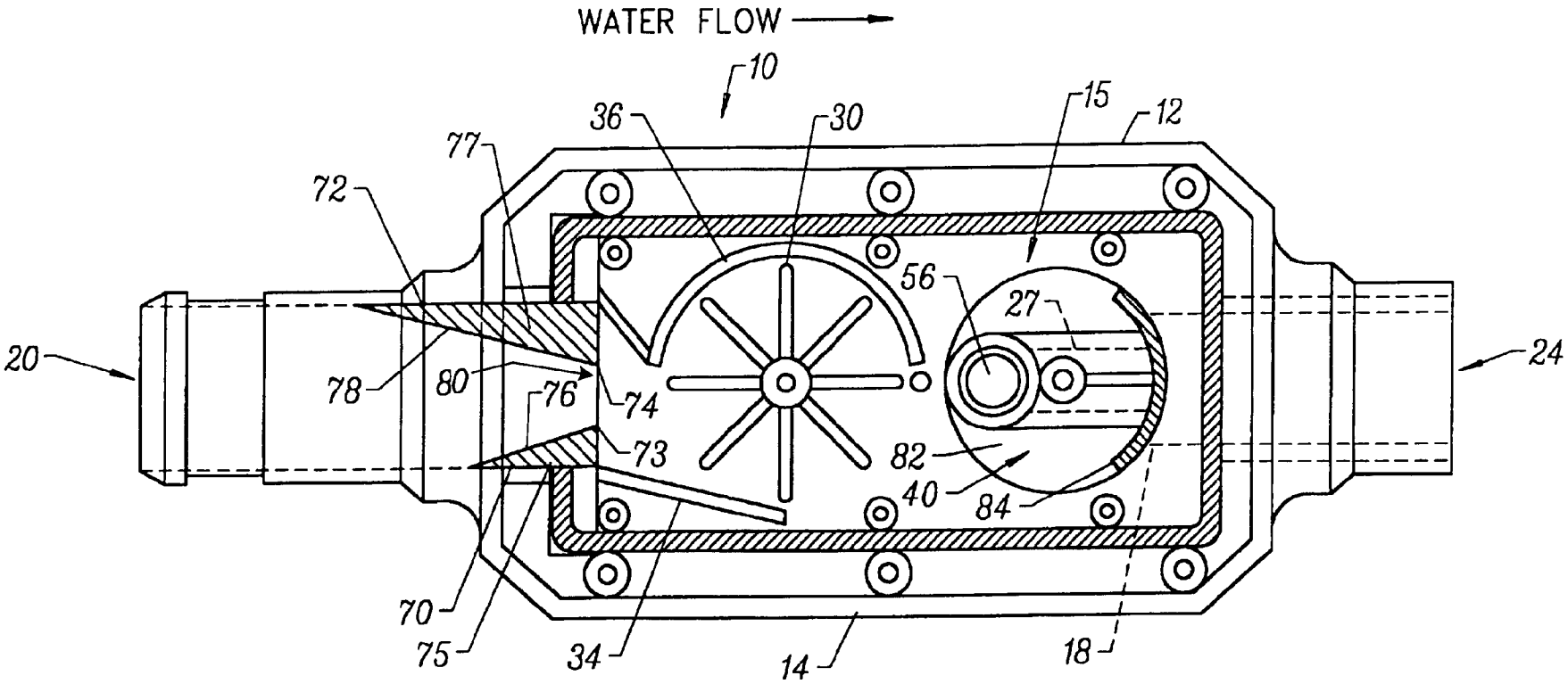
FIG. 2 is a top, partial cutaway view of a first embodiment of a backup valve in accordance with the present invention.

A first embodiment of the valve is shown in FIG. 2. The inflow to this valve is designed for use in lower pressure embodiments, such as, for example, where the volume of water supplied to the valve is on the order of 10-15 gallons per minute, having a pressure of about 10-30 psi.

Figure 3:
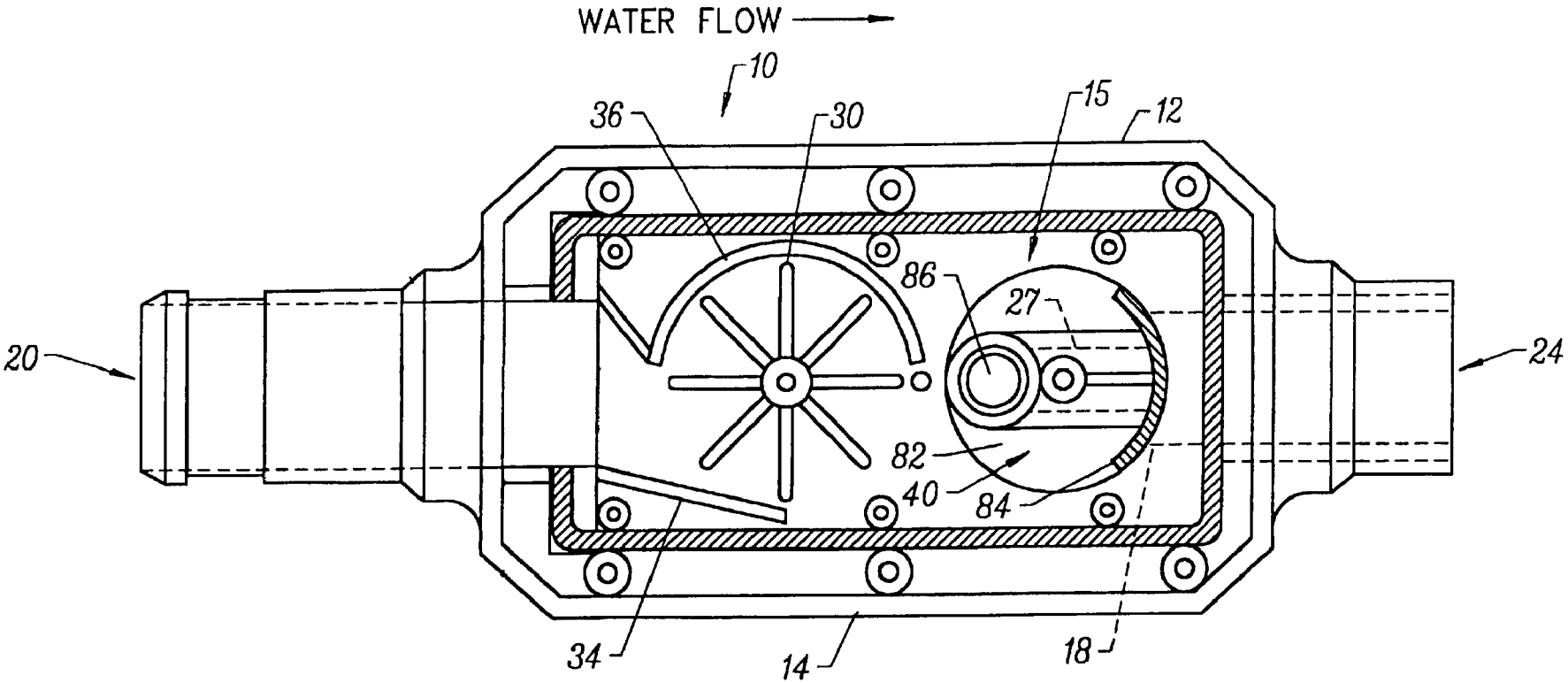
FIG. 3 is a top, partial cutaway view of a second embodiment of a backup valve in accordance with the present invention.
Figure 4:
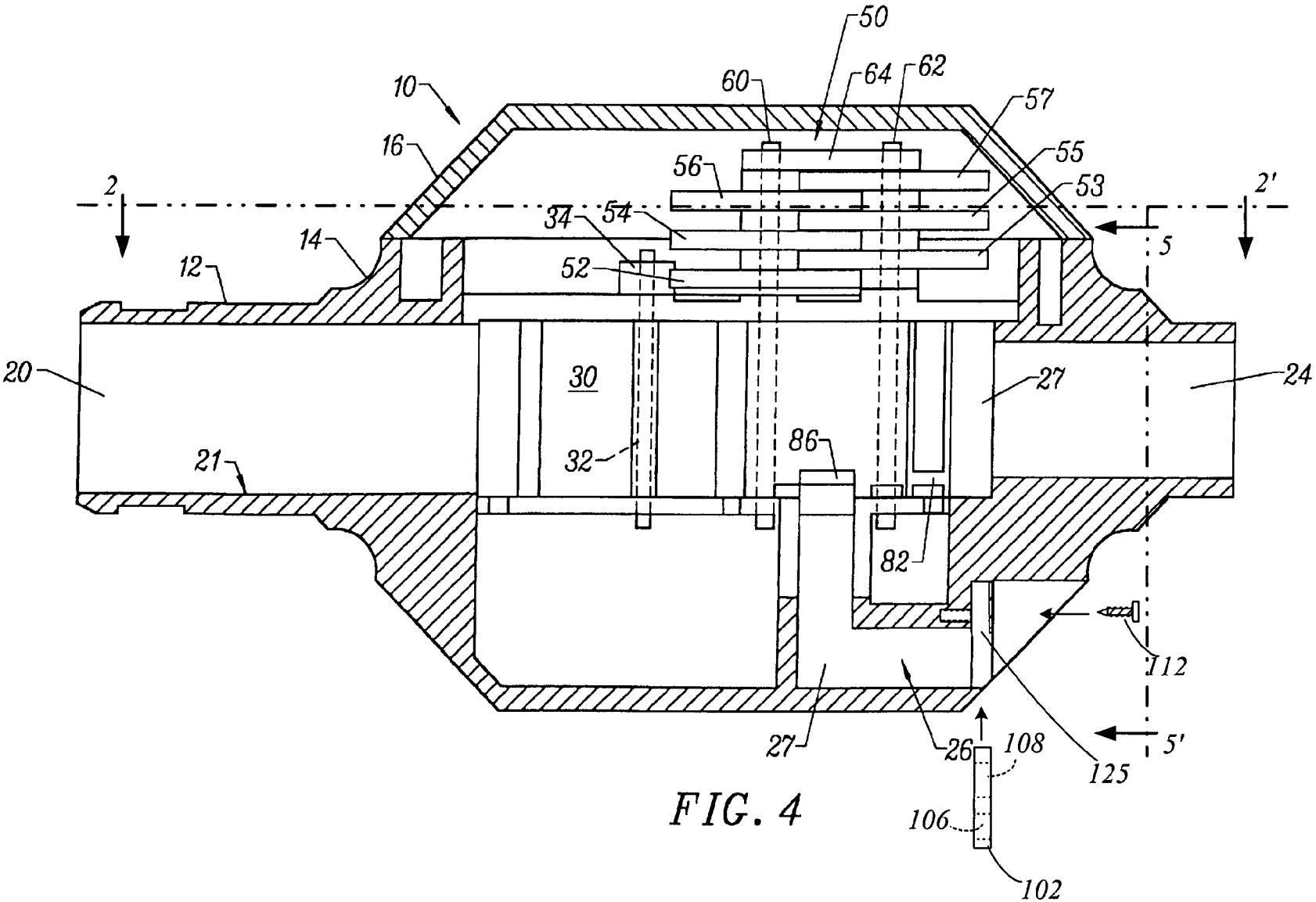
FIG. 4 is an exposed side view of the backup valve shown in FIG. 2 or 3.

FIG. 3. shows a second embodiment of the backup valve of the present invention without the pressure inducer inlet of FIG. 2. Use of this embodiment is appropriate in applications where the flow pressure applied to inlet 20 is in a range of 35-50 psi, and in particular 40-45 psi.

In both embodiments, it would be desirable to allow the user of a cleaner a choice as to those circumstances in which the user wishes to use a conventional flow and those wherein the user wishes to provide an increased flow.

Referring to FIGS. 2-7, a first valve 10 (FIG. 2) or second valve 10' (FIG. 3) includes a housing 12 having a first inlet 20, and first 24 and second 26 outlets. The inlet 20 is coupled to a water supply hose 120 which is itself coupled to a water supply source (not shown), such as a skimmer pump, booster pump or other portion of the pool's filtration system. Inlet 20 and outlets 24 and 26 are generally cylindrical, and are formed as part of a lower housing 14, which is sealably attached to a housing cover 16 to complete housing 12. Housing 12 may be pressure molded of plastic or other suitable material.

Mounted in housing 12 are a timing mechanism comprising an impeller 30, gears 50, and a rotating diverter valve structure 40. Impeller 30 is rotatably mounted on a shaft 32 in lower housing 14. At a first end of shaft 32, a gear 34 couples shaft 32 to a set of gears 50, and specifically gear 52. A first set of gears, 52, 54, and 56 are mounted on axis 60 while gears 53, 55, and 57 are mounted on axis 62. Each individual gear 52-57 includes a large sprocket engaging a smaller sprocket of the next vertically arranged gear. All gears 52-57 are secured to either axes 60, 62, respectively, by a clamp 64. Gears 52-57 are free to rotate about the axes, while gear 57 is attached to axis 62 to drive rotation of the valve structure 40.

Diverter valve structure 40 includes a washer plate 82 and a semi-cylindrical valve door 84 which engages a semi-cylindrical portion 18 of housing 12 to prevent water flow through first outlet 24. Plate 82 includes a bore 86 which opens inner chamber 15 of housing 12 to channel 27, leading to outlet 26.

Walls 34, 36 generally surround impeller 30 in order to direct water around impeller 30 to rotate impeller 30 on shaft 32.

A channel leading to inlet 20 has a cylindrical opening generally having a circular cross section to allow the pressurized water entering the backup valve 10 to flow freely to impeller 30. In the low pressure embodiment of FIG. 2, a pressure inducer comprising ramps 70,72 is provided to increase the speed of fluid flow into the impeller 30. Alternatively, in the second embodiment shown in FIG. 3, a pressure inducer is not be utilized.

Ramps 70,72 compress the water flow, increasing the pressure and consistency of the flow to the impeller without reducing the volume of water through valve 10, resulting in a valve 10 which provides consistent timing for the redirection and backup operation. Notably, ramps 70, 72 are of different lengths. Ramp 70, the shorter of the two ramps, has a triangular cross section as viewed from the top view of FIG. 3. Ramp 70 has a flat upper surface 76 and a semi-cylindrical back side 75 which allows ramp 70 to fit securely against the inner wall of inlet 20. Likewise, ramp 72, the longer of the two ramps, has a flat upper surface 78 and a semi-cylindrical back side 77, which allows it to fit securely in a directly opposing relationship to ramp 70. Surfaces 76 and 77 terminate in edges 73 and 74 to form a slit 80 through which water entering inlet 20 is compressed when it enters inner chamber 15 of valve 10.

Ramps 70 and 72 may be formed in accordance with the teachings of '464 Patent.

In a unique aspect of the present invention, the backup valve includes a reverse flow regulator 102 positioned adjacent to the outlet 26. The pressure regulator 102 allows the cleaner user to adjust the outflow of the valve to increase the speed of the flow though outlet 26, thereby providing more thrust for certain cleaning environments and for certain cleaners. For example, the cleaner disclosed in U.S. Design patent application Ser. No. 29/171,340 (filed Nov. 20, 2002, entitled "Truck Cleaner", inventor Sanford Campbell) weighs more than the cleaner design in U.S. Pat. No. 5,933,899. Use of the backup valve of the present invention improves the reverse flow power of the valve and the ability of the valve to move the cleaner in a direction opposite to that of the cleaner's drive.

In a first embodiment, shown in FIGS. 4-7, the regulator 102 comprises a plate having a first opening 108 of a first diameter and a second opening 106 of a smaller diameter. The plate includes two bores, 110*a* and 110*b*, which allow the plate to be secured by a threaded screw 112 into the cleaner body 12. To adjust the flow, the user merely selects which of bore 106 (small size) or 108 (full size) the user wishes to use, slides the plate in slot 125 in body 12, and secures the plate with screw 112. The user can empirically determine which of the two bores are better suited for the application and cleaner the user has selected.

In one embodiment, a bore 108 and outlet 26 have a diameter of ⅜", and bore 106 has a diameter of about ¼". It should be understood that the above dimensions are exemplary, and may change with characteristics such as the size of the valve, the application (in terms of the configuration of the pumping system used with the valve and cleaner) and the flow rate and pressure of the water flow to the cleaner. The ratio of the diameter of the larger, unrestricted hole to the smaller hole may thus be on the order of 3:1 to 1.1:1, and more particularly, 2:1 to 1.1:1 and more particularly 1.6:1 to 1.4:1.

Figure 5:
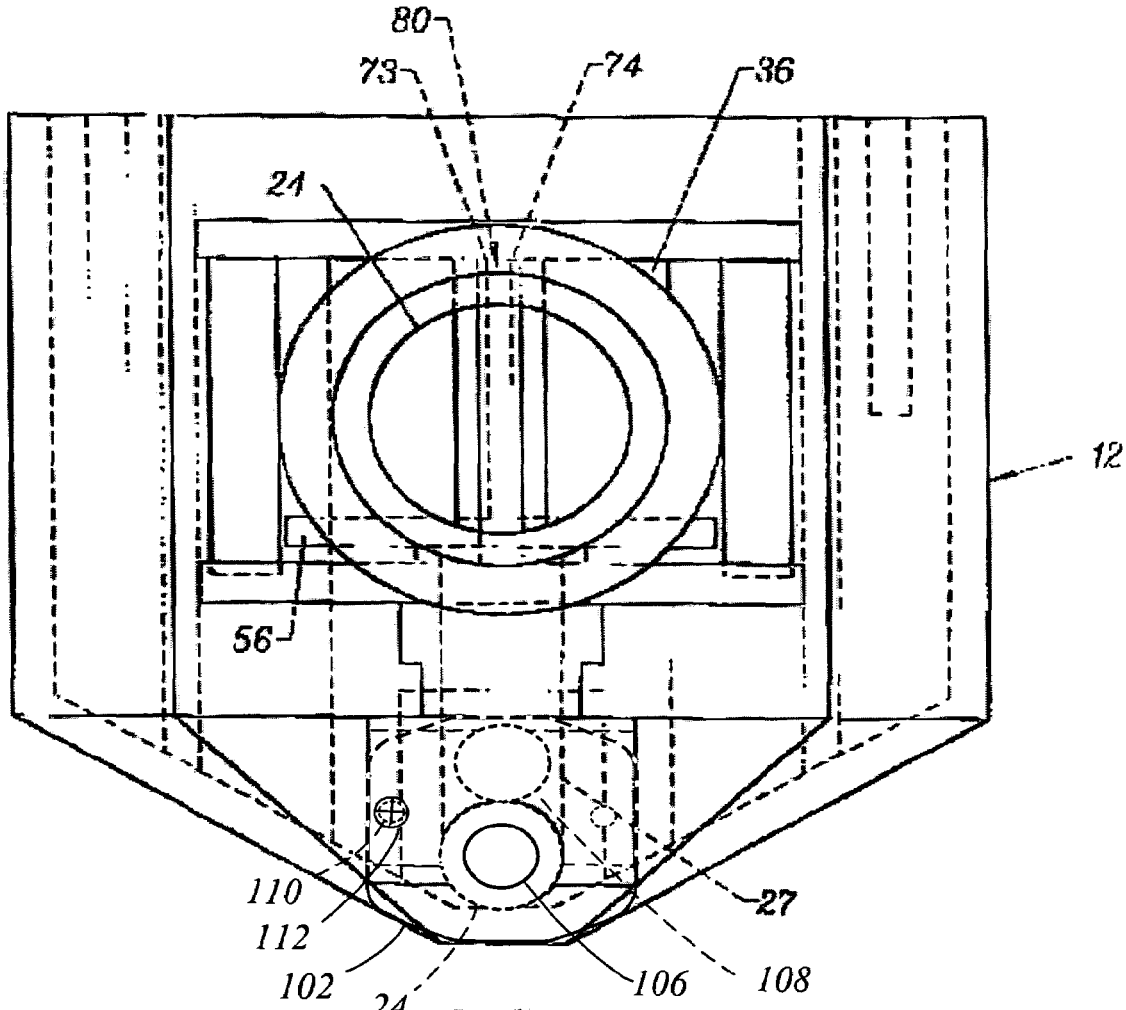
FIG. 5 is an end view of the backup valve along arrow 5-5 in FIG. 4.
Figure 6:
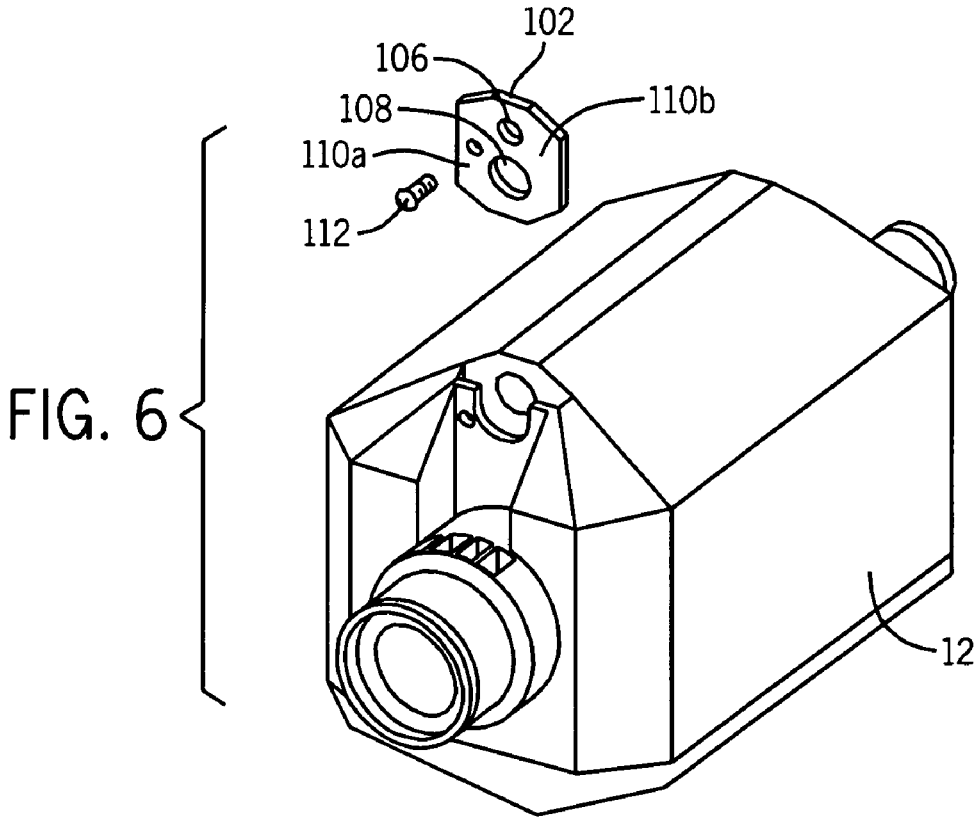
FIG. 6 is a perspective, exploded view of the improved backup valve of the present invention.
Figure 7:
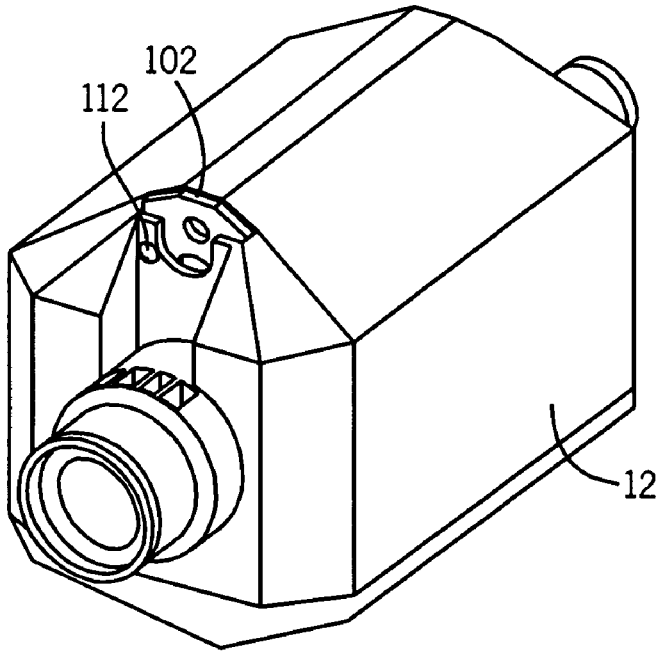
FIG. 7 is a perspective, assembled view of the improved backup valve of the present invention.

As shown in FIG. 5, the plate fits snugly in slot 125 and is formed as a hexagon so its edges conform to the outer shape of the body 12 when secured by screw 112. It should be understood that the particular shape of the plate could be any of a number of suitable shapes configured to secure one of bores 106, 108 over the outlet 26.

Figure 8:
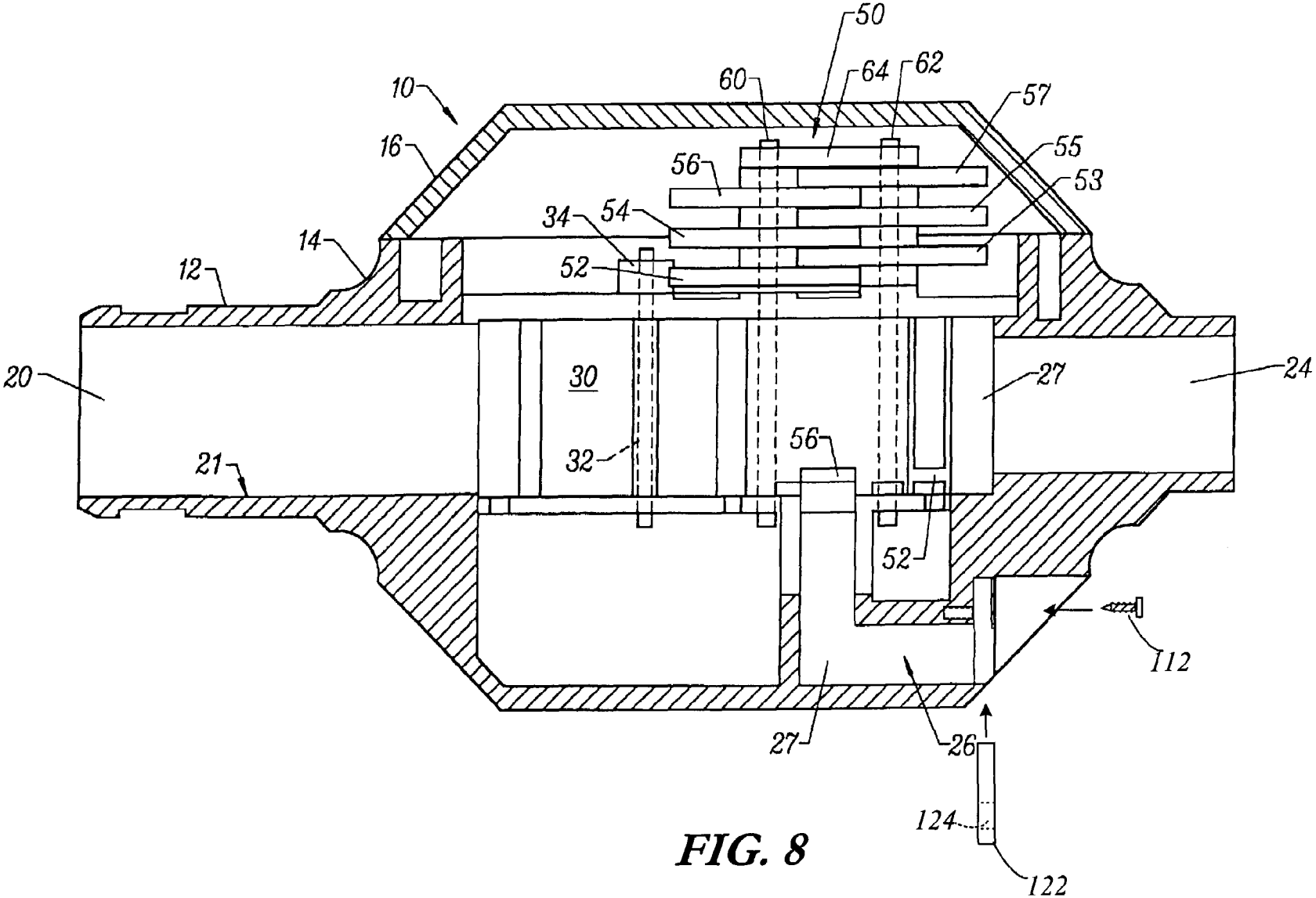
FIG. 8 is an exposed side view of a second embodiment of the improved backup valve of the present invention.
Figure 9:
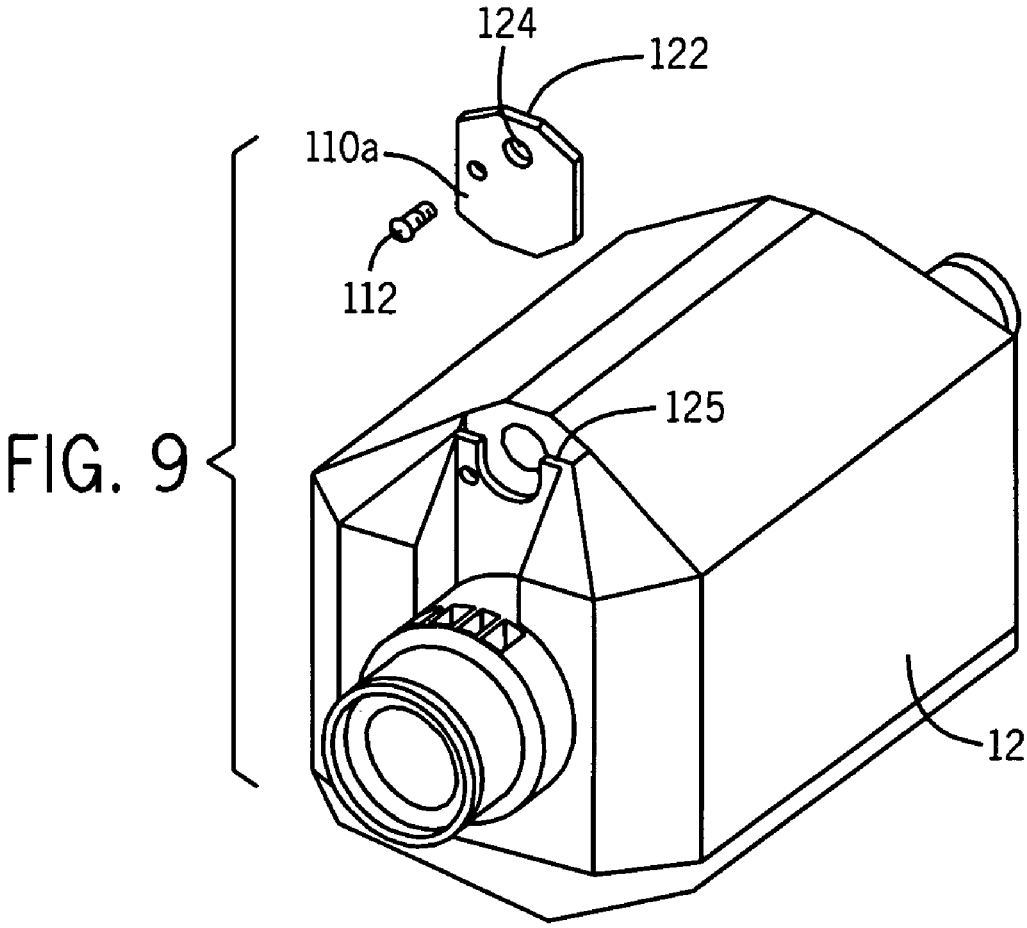
FIG. 9 is a perspective, exploded view of the second embodiment of the improved backup valve of the present invention.

FIGS. 8 and 9 show a second alternative embodiment of the invention. In this embodiment, only bore 106 is provided in plate 124. In this case, to utilize the larger bore flow of the circumference of outlet 26, the plate 122 is simply left off the backup valve. Plate 122 is secured to the backup valve 12 in the same manner as the plate 102. Bore 122 has dimensions equal to those set forth above with respect to bore 106.

Figure 10:
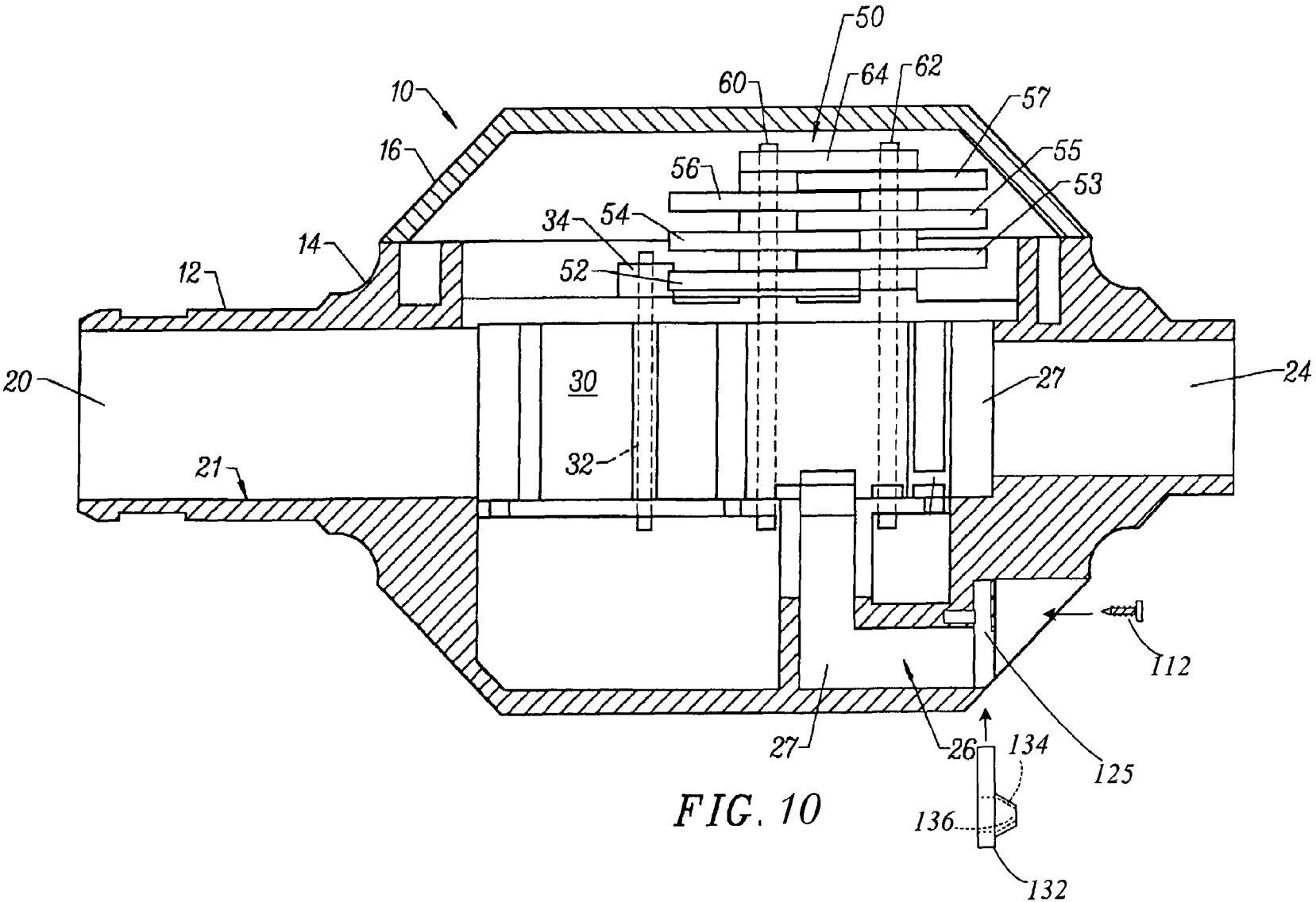
FIG. 10 is an exposed side view of a third embodiment of the improved backup valve of the present invention.

FIG. 10 shows yet another embodiment of the invention. In this embodiment, the regulator 132 includes a conical body 134 having at one end a bore having a diameter equal to that of outlet 26, and tapering to an opening 136 having a diameter equivalent to that of bore 106. In this embodiment, the tapered edges of the conical member 134 aid in accelerating the flow of water exiting the body 12. It should be recognized that any number of members may take the place of the conical body 134, and that a conical shape is not required. For example, a ramped tube similar in configuration to tube 20 using ramps similar to ramps 70 and 72 could be used with equal effect. All such embodiments are contemplated as being within the scope of the present invention.

Based on the foregoing, it will be appreciated that an improved backup valve has been shown and described that has enhanced ability to function in both low pressure and high pressure water supply environments. The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A backup valve for use with a pool cleaner coupled to a source of water under pressure, comprising:

a housing having an inlet and at least a first outlet and a second outlet;

a timing apparatus directing water from said inlet to the first outlet or the second outlet; and an adjustable flow controller over the second outlet provided to increase the flow speed of fluid exiting the outlet, the flow controller including a securable plate, the securable plate including a first bore having a diameter smaller than a diameter of said second outlet.

2. The backup valve of claim 1 wherein the plate includes a second bore having a diameter equal to the diameter of said second outlet.

3. The backup valve of claim 2 wherein the plate is secured in a first or second position by a user adjustable screw.

4. The backup valve of claim 1 wherein the flow controller includes a flow control structure on the plate.

5. The backup valve of claim 2 wherein a ratio of the diameter of the second bore to the diameter of the first bore is about 3:1 to 1.1:1.

6. The backup valve of claim 5 wherein said ratio is about 1.6:1 to 1.4:1.

7. The backup valve of claim 4 wherein the flow control structure is a conical structure.

* * * * *